US011323821B2

(12) United States Patent
Kim et al.

(10) Patent No.: US 11,323,821 B2
(45) Date of Patent: May 3, 2022

(54) VIBRATION SPEAKER

(71) Applicants: Hyundai Motor Company, Seoul (KR); Kia Motors Corporation, Seoul (KR); Postech Academy-Industry Foundation, Pohang-si (KR)

(72) Inventors: Youngbeom Kim, Bucheon-si (KR); Minsik Yang, Yongin-si (KR); Yonghwan Hwang, Hwaseong-si (KR); Won Kyu Moon, Pohang-si (KR); Ingyu Lee, Suwon-si (KR)

(73) Assignees: Hyundai Motor Company, Seoul (KR); Kia Motors Corporation, Seoul (KR); Postech Academy-Industry Foundation, Pohang-si (KR)

( * ) Notice: Subject to any disclaimer, the term of this patent is extended or adjusted under 35 U.S.C. 154(b) by 0 days.

(21) Appl. No.: 17/038,856

(22) Filed: Sep. 30, 2020

(65) Prior Publication Data

US 2021/0321200 A1 Oct. 14, 2021

(30) Foreign Application Priority Data

Apr. 9, 2020 (KR) ..... 10-2020-0043008

(51) Int. Cl.
*H04R 9/06* (2006.01)

(52) U.S. Cl.
CPC ..... *H04R 9/06* (2013.01); *H04R 2400/03* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,506,117 | A * | 3/1985 | Fresard | H04R 9/066 381/162 |
| 7,218,745 | B2 * | 5/2007 | McConnell | B60R 11/0235 381/152 |
| 8,494,208 | B2 * | 7/2013 | Fordham | H04R 7/045 381/396 |
| 10,674,271 | B2 * | 6/2020 | Ikeuchi | H04R 7/26 |
| 10,728,669 | B2 * | 7/2020 | Choi | H04R 9/063 |
| 2008/0285769 | A1 * | 11/2008 | Toyama | B60R 11/0223 381/86 |
| 2009/0262960 | A1 * | 10/2009 | Kim | H04R 9/045 381/191 |
| 2014/0054984 | A1 * | 2/2014 | Tang | H04R 9/046 310/28 |
| 2020/0280796 | A1 * | 9/2020 | Lee | H04R 1/26 |

* cited by examiner

*Primary Examiner* — Angelica M McKinney
(74) *Attorney, Agent, or Firm* — Morgan, Lewis & Bockius LLP

(57) ABSTRACT

A vibration speaker may include a vibration plate fixed to a housing, a vibrator mounted in the housing to vibrate in a vibration direction of the vibration plate and having a magnet forming a magnetic field, a voice coil member configured to vibrate the vibration plate through interaction of the magnet with the vibrator, and a vibration transmission member configured to support the voice coil member in a state of being fixed to an internal surface of the vibration plate and transmit vibration of the voice coil member to the vibration plate, wherein the vibration transmission member includes a spacing support portion fixed to the voice coil member to be spaced from the internal surface of the vibration plate, and a vibration transmission portion protruding from the spacing support portion to be fixed to the internal surface of the vibration plate.

14 Claims, 5 Drawing Sheets

VIBRATION SPEAKER

CROSS-REFERENCE TO RELATED APPLICATION(S)

The present application claims priority to Korean Patent Application No. 10-2020-0043088, filed on Apr. 9, 2020, the entire contents of which is incorporated herein for all purposes by this reference.

BACKGROUND OF THE INVENTION

Field of the Invention

The present invention relates to a vibration speaker capable of improving low tone output and preventing sound pressure drop and sound distortion.

Description of Related Art

Electric vehicles (EV), plug-in hybrid vehicles (PHEV), and hybrid vehicles (HEV) that are driven by the power of an electric motor cause a risk of colliding with pedestrians because they do not make much noise when driving. Therefore, a virtual engine sound system (VESS) to prevent the risk of a pedestrian collision by generating engine noise with a vibration speaker is applied to these vehicles.

A vibration speaker used in a virtual engine sound system includes a vibration plate provided in a portion of the housing, a voice coil member coupled to the vibration plate, and a vibrator provided with a magnet mounted in the housing to be vibrated by an elastic member to operate the voice coil member. The vibration speaker is excellent in durability, small in size, and inexpensive.

However, in such a vibration speaker, the voice coil member is directly fixed to an internal surface of the vibration plate and a contact area between the vibration plate and the voice coil member is large, so that the voice coil member may not effectively vibrate the vibration plate and there is a limit to increasing low tone output.

Also, in a conventional vibration speaker, because a vibrator is supported on a housing through an elastic member, as unstable vibrations (rotation and inclined vibrations) of the vibrator occurs during sound output, a force that the vibrator excites the voice coil member may decrease, causing sound pressure drop and sound distortion.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a vibration speaker configured for improving low tone output.

Various aspects of the present invention are directed to providing a vibration speaker configured for preventing sound pressure drop and sound distortion by suppressing unstable vibrations of a vibrator.

Additional various aspects of the present invention will be set forth in portion in the description which follows, and in part, will be obvious from the description, or may be learned by practice of the present invention.

In accordance with an aspect of the present invention, a vibration speaker includes a vibration plate fixed to a housing, a vibrator mounted in the housing to vibrate in a vibration direction of the vibration plate and having a magnet forming a magnetic field, a voice coil member configured to vibrate the vibration plate through interaction of the magnet with the vibrator, and a vibration transmission member configured to support the voice coil member in a state of being fixed to an internal surface of the vibration plate and transmit vibration of the voice coil member to the vibration plate, wherein the vibration transmission member includes a spacing support portion fixed to the voice coil member to be spaced from the internal surface of the vibration plate, and a vibration transmission portion protruding from the spacing support portion to be fixed to the internal surface of the vibration plate.

The vibration transmission portion may be provided at a position coincident with the center portion of the voice coil member, and a cross-sectional area of a portion thereof fixed to the vibration plate may be smaller than a cross-sectional area of the voice coil member.

The vibration speaker may further include a circumferential support member provided in a shape surrounding the outside of the vibration transmission member, and having one side fixed to a circumference of the voice coil member and the other side fixed to the internal surface of the vibration plate.

The circumferential support member may be made of an elastic material and provided to gradually increase in diameter from the voice coil member toward the vibration plate.

The vibration speaker may further include an elastic connection member connecting a circumference of the voice coil member and the vibrator, and an advance and retreat guide supporting an external circumference of the vibrator to guide advance and retreat of the vibrator.

The advance and retreat guide may include at least one guide structure fixed in the housing and including a support portion provided in a shape corresponding to the circumference of the vibrator, and a bearing located between an internal surface of the guide structure and an external surface of the vibrator to slidably support the vibrator.

In accordance with another aspect of the present invention, a vibration speaker includes a vibration plate fixed to a housing, a vibrator mounted in the housing to vibrate in a vibration direction of the vibration plate and having a magnet forming a magnetic field, and a voice coil member configured to vibrate the vibration plate through interaction of the magnet with the vibrator, wherein the voice coil member includes a bobbin on which a coil is wound and including a connection plate facing an internal surface of the vibration plate at one end portion thereof, and a vibration transmission portion protruding from the center portion of the connection plate to be fixed to the vibration plate.

The vibration transmission portion may be provided integrally with the connection plate, and a cross-sectional area of a portion thereof fixed to the vibration plate may be smaller than that of the bobbin.

The vibration speaker may further include a circumferential support member provided in a shape surrounding the outside of the vibration transmission portion and having one side fixed to a circumference of the voice coil member and the other side fixed to the internal surface of the vibration plate.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
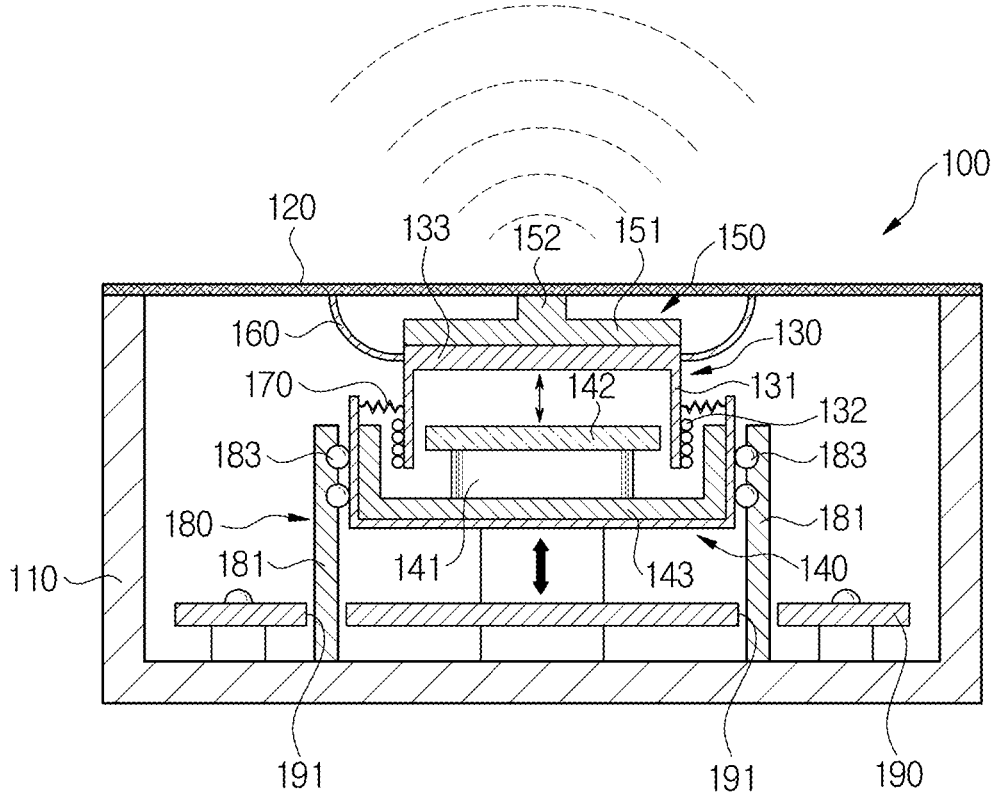
FIG. 1 illustrates a vibration speaker according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter embodiments of the present invention will be described in detail with reference to the accompanying drawings. The exemplary embodiments described below are provided by way of example so that those skilled in the art will be able to fully understand the spirit of the present invention. The present invention is not limited to the exemplary embodiments described below, but may be embodied in other forms. To clearly explain various exemplary embodiments of the present invention, portions not related to the description are omitted from the drawings, and the width, length, thickness, etc. of the components may be exaggerated for convenience.

Figure 2:
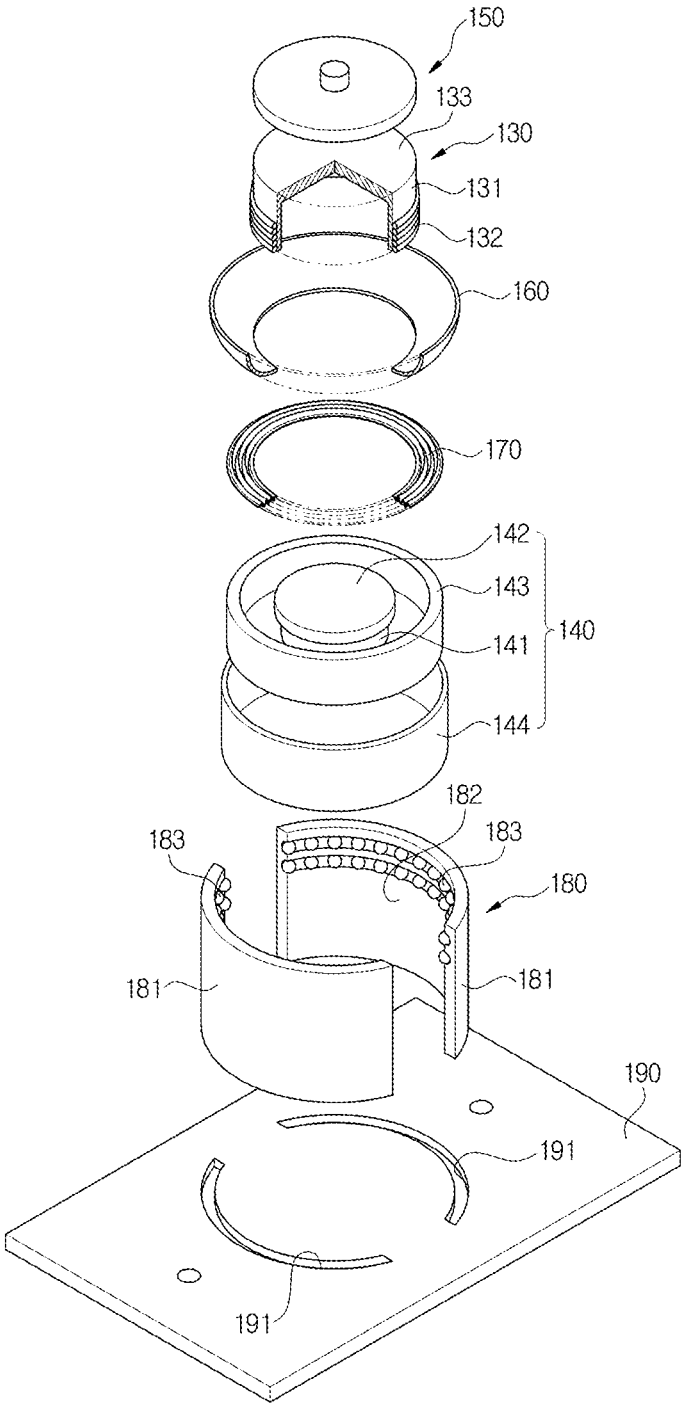
FIG. 2 is an exploded perspective view of main components of the vibration speaker according to various exemplary embodiments of the present invention.
Figure 3:
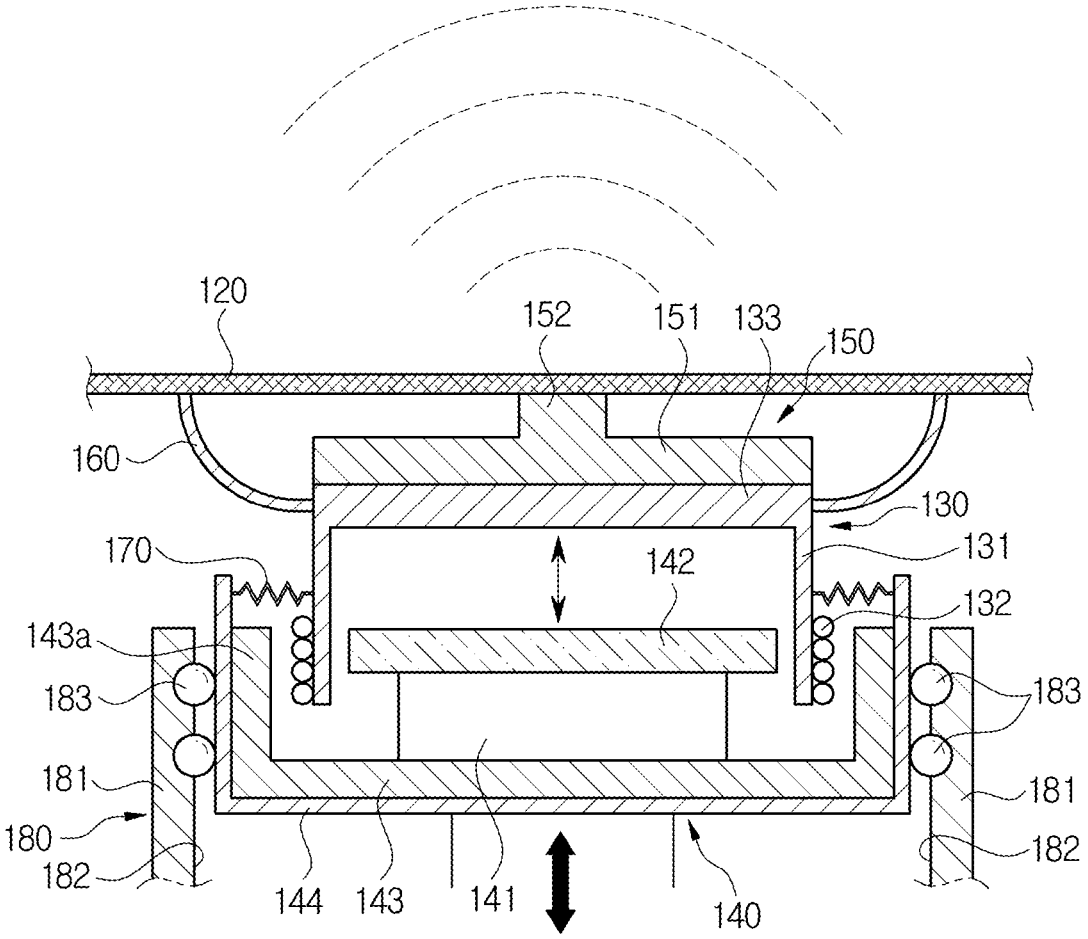
FIG. 3 is a cross-sectional view of the main components of the vibration speaker according to various exemplary embodiments of the present invention.

Referring to FIG. 1, FIG. 2, and FIG. 3, a vibration speaker 100 according to various exemplary embodiments of the present invention may include a housing 110, a vibration plate 120, a voice coil member 130, a vibrator 140, a vibration transmission member 150, a circumferential support member 160, an elastic connection member 170, an advance and retreat guide 180, and a circuit board 190.

The housing 110 may be provided in a substantially cylindrical shape, and has a space for accommodating the vibration transmission member 150, the voice coil member 130, the vibrator 140, the advance and retreat guide 180, etc. The housing 110 may have a shape in which one side to which the vibration plate 120 is coupled is open and the other side thereof is closed. However, the housing 110 is not limited to a cylindrical shape, and may be changed into various shapes according to an installation environment.

The vibration plate 120 may have a rim fixed to an end portion of the open side of the housing 110 to cover the open side of the housing 110. The vibration plate 120 may be provided as a thin plate and may generate sound by vibration.

The voice coil member 130 is mounted on the vibration plate 120 via the vibration transmission member 150 and may vibrate the vibration plate 120 through interaction with the vibrator 140. The voice coil member 130 may have a form in which a coil 132 is wound on an external surface of a cylindrical bobbin 131 and may include a connection plate 133 of an integral type fixed to the vibration transmission member 150 on a side opposite to the vibration plate 120. A high-frequency AC current in an audible frequency band is applied to the voice coil member 130.

As illustrated in FIGS. 1 and 3, the vibrator 140 is mounted to be able to vibrate in a vibration direction of the vibration plate 120 in the housing 110. The vibrator 140 includes a magnet 141, a first yoke 142 provided in a disk shape to be configured to enter an internal space of the voice coil member 130 and coupled to one end portion of the magnet 141 to face the connection plate 133 of the voice coil member 130, and a second yoke 143 coupled to the other end portion of the magnet 141 opposite to the first yoke 142. The second yoke 143 includes a cylindrical extension portion 143*a* (see FIG. 3) having a diameter greater than an external diameter of the voice coil member 130 and extending from a rim thereof to surround the outside of the voice coil member 130. The vibrator 140 may include a cylindrical case 144 to surround and protect the outside of the second yoke 143.

The elastic connection member 170 connects the voice coil member 130 and the vibrator 140 and supports the vibrator 140 to be configured to advance and retreat in the vibration direction of the vibration plate 120. As illustrated in FIG. 2, the elastic connection member 170 may be provided in an annular shape connecting an upper circumference of the case 144 of the vibrator 140 and a lateral circumference of the voice coil member 130, or may include a plurality of connection springs mounted at equal intervals with each other along a circumference thereof. Because the vibrator 140 is connected to the voice coil member 130 by the elastic connection member 170, the vibrator 140 may advance and retreat within a set range without being separated.

Referring to FIG. 3, the coil 132 of the voice coil member 130 is positioned in a state of being spaced from the first yoke 142 and the second yoke 143 in a gap between the first yoke 142 and the second yoke 143 of the vibrator 140, and the magnet 141 has a N pole and a S pole formed on the first yoke 142 and the second yoke 143 to form a magnetic field passing through the coil 132. Therefore, when an output signal (current signal) is applied to the coil 132, the voice coil member 130 vibrates, and the vibration plate 120 vibrates due to advance and retreat of the voice coil member 130, so that sound may be output. In the instant case, the vibrator 140 also vibrates.

The vibration transmission member 150 transmits the vibration of the voice coil member 130 to the vibration plate 120 while supporting the voice coil member 130 in a state of being fixed to an internal surface of the vibration plate 120. The vibration transmission member 150 may include a spacing support portion 151 fixed to the connection plate 133 of the voice coil member 130 and maintaining a spacing with the internal surface of the vibration plate 120, and a vibration transmission portion 152 protruding from the spacing support portion 151 to be fixed to the vibration plate 120.

The vibration transmission portion 152 may be provided at a position coincident with the center portion of the spacing support portion 151 and the voice coil member 130. The vibration transmission portion 152 is provided such that a cross-sectional area of a portion thereof fixed to the vibration plate 120 is smaller than that of the connection plate 133 of the voice coil member 130.

Accordingly, the vibration transmission member 150 transmits the vibration energy transmitted from the voice coil member 130 to the vibration plate 120 through the vibration transmission portion 152 having a relatively small cross-sectional area, so that the vibration energy may be concentrated in the center portion of the vibration plate 120, and through the concentrated vibration energy, the vibration plate 120 may be effectively excited to improve low tone output. Accordingly, by reducing the cross-sectional area of the vibration transmission portion 152 to concentrate the vibration energy at the center portion of the vibration plate 120, the vibration plate 120 may vibrate more smoothly compared to a conventional one and may improve the output of a low tone band.

As illustrated in FIG. 2 and FIG. 3, the circumferential support member 160 may be provided in a cup shape surrounding the outside of the vibration transmission member 150. One side of the circumferential support member 160 may be fixed to a circumference of the voice coil member 130 and the other side of the circumferential support member 160 may be fixed to the internal surface of the vibration plate 120.

The circumferential support member 160 may be made of an elastic material or a material which is thinner than the vibration plate 120 and deformable so that the vibration energy of the voice coil member 130 is transmitted to the vibration transmission portion 152 and at the same time does not interfere with the vibration of the vibration plate 120. Also, the circumferential support member 160 may be provided to gradually increase in diameter from the voice coil member 130 toward the vibration plate 120.

The circumferential support member 160 may suppress unstable vibrations (rotation and inclined vibrations) of the voice coil member 130 so that the vibration energy of the voice coil member 130 is smoothly transmitted to the vibration plate 120, and may prevent a fixing portion between the vibration transmission portion 152 and the vibration plate 120 from being damaged or separated.

The advance and retreat guide 180 supports an external circumference of the vibrator 140 to guide the advance and retreat of the vibrator 140. As illustrated in FIG. 2, the advance and retreat guide 180 may include a plurality of guide structures 181 fixed to an internal surface of the housing 110 and having a curved support portion 182 formed in a shape corresponding to the circumference of the vibrator 140, and bearings 183 located between an internal surface of each of the guide structures 181 and an external surface of the vibrator 140 to support the vibrator 140 in a slidable manner. As illustrated in FIG. 3, the exemplary embodiment illustrates that two of the guide structures 181 provided in a substantially semi-cylindrical shape support the external surface of the vibrator 140 from opposite sides.

The advance and retreat guide 180 may suppress unstable vibrations (rotation and inclined vibrations) of the vibrator 140 to guide the vibrator 140 to advance and retreat only in the vibration direction of the vibration plate 120. Accordingly, sound pressure drop or sound distortion due to unstable vibrations of the vibrator 140 may be prevented.

As illustrated in FIG. 1 and FIG. 2, the guide structures 181 of the advance and retreat guide 180 may be fixed to the internal surface of the housing 110 in a state of penetrating the circuit board 190 mounted in the housing 110. The circuit board 190 may be provided with through grooves 191 through which the guide structures 181 may pass without interference.

Figure 4:
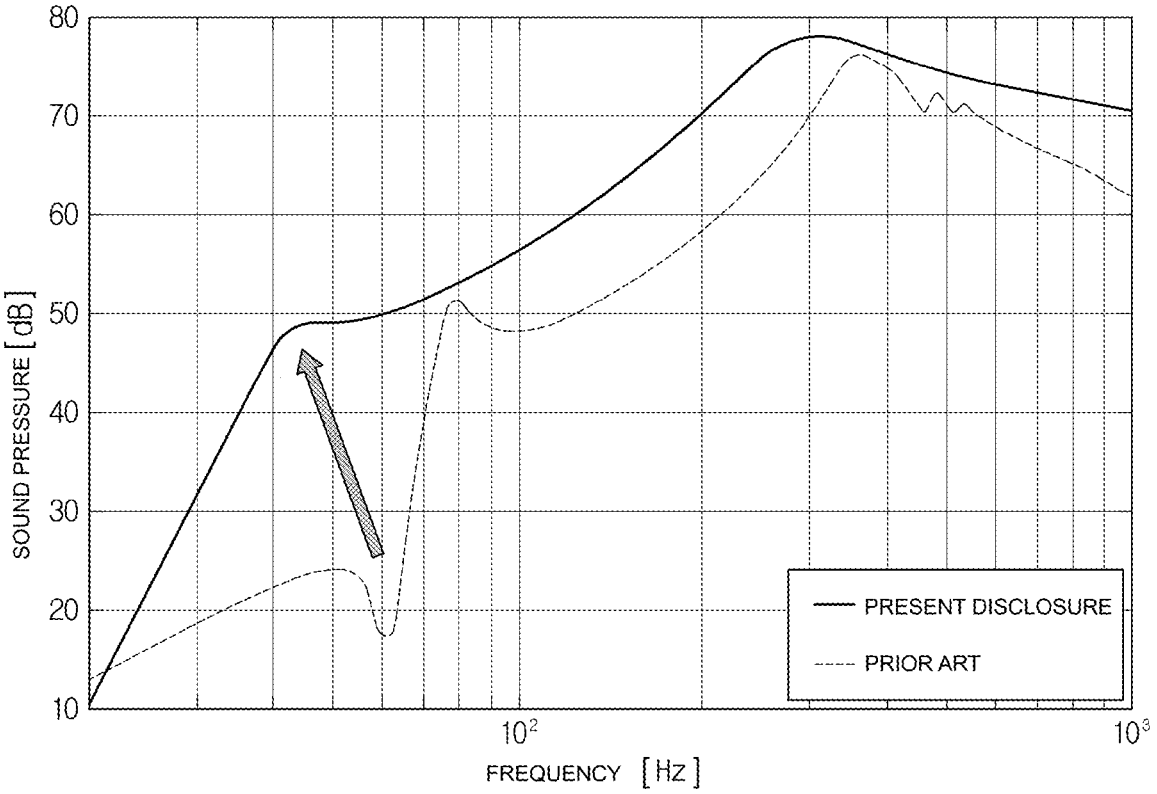
FIG. 4 is a comparison graph of performances of the vibration speaker according to various exemplary embodiments of the present invention and a conventional vibration speaker.

FIG. 4 is a comparison graph of performances of the vibration speaker 100 according to the exemplary embodiment and a conventional vibration speaker. As illustrated in FIG. 4, the vibration speaker 100 according to the exemplary embodiment may significantly improve sound pressure in a low frequency band compared to a conventional one. Furthermore, because unstable vibrations of the circumferential support member 160 and the vibrator 140 may be prevented, a phenomenon in which sound is distorted in the low frequency band may also be prevented. This is because the vibration energy of the voice coil member 130 is not only transmitted to the vibration plate 120 through the vibration transmission portion 152 of the vibration transmission member 150, but also unstable vibrations of the voice coil member 130 is suppressed by the circumferential support member 160 and unstable vibrations of the vibrator 140 is suppressed by the advance and retreat guide 180.

Figure 5:
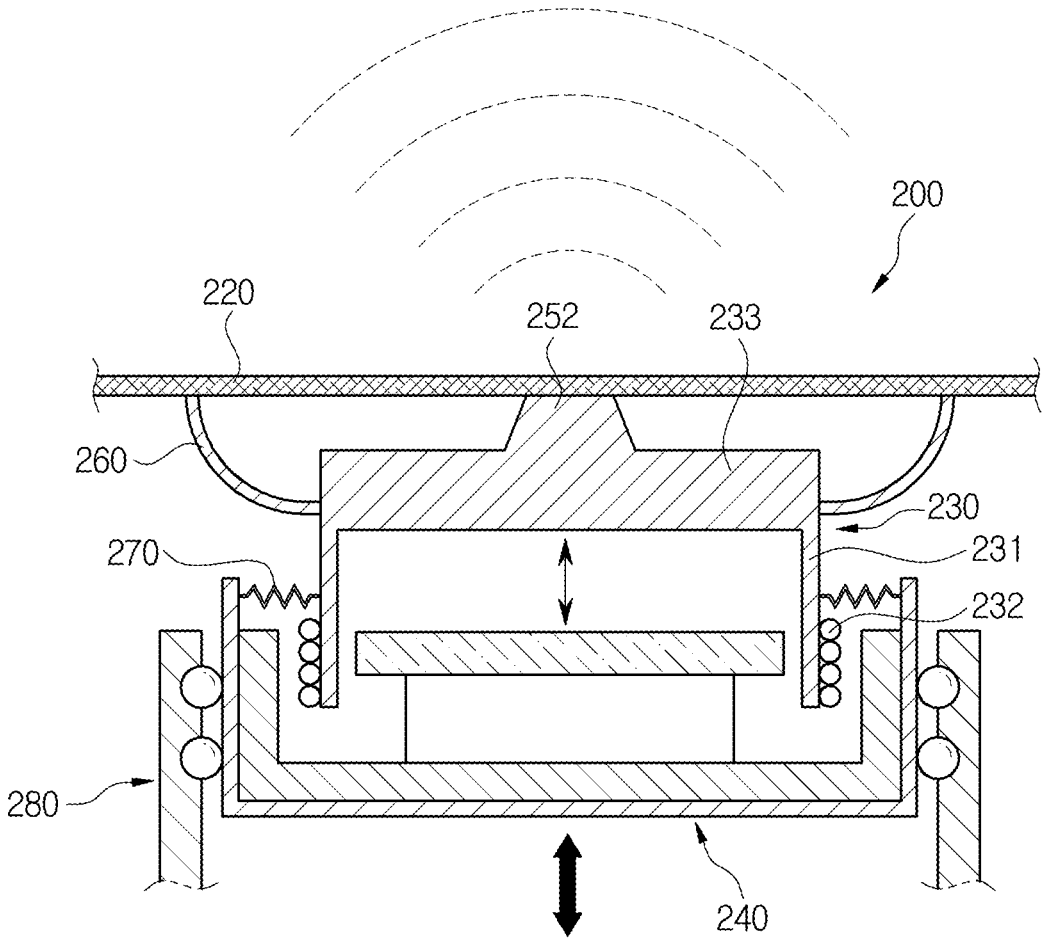
FIG. 5 illustrates a vibration speaker according to various exemplary embodiments of the present invention.

FIG. 5 illustrates a vibration speaker 200 according to various exemplary embodiments of the present invention. In the vibration speaker 200 of FIG. 5, a vibration transmission portion 252 connected to a vibration plate 220 is integrally formed with a voice coil member 230.

The voice coil member 230 may include a bobbin 231 having a coil 232 wound around a circumference thereof and a connection plate 233 facing an internal surface of the vibration plate 220 at one end portion thereof, and the vibration transmission portion 252 protruding toward the vibration plate 220 from the center portion of the connection plate 233 of the bobbin 231 to be fixed to the center portion of the vibration plate 220. The vibration transmission portion 252 may be integrally formed with the connection plate 233 of the bobbin 231 and may be provided such that a cross-sectional area of a portion thereof fixed to the vibration plate 220 is smaller than that of the connection plate 233 of the bobbin 231.

The remaining components of the vibration speaker 200 of FIG. 5 may be provided in the same manner as in the example of FIG. 1. A housing, the vibration plate 220, a vibrator 240, a circumferential support member 260, an elastic connection member 270, and an advance and retreat guide 280 may be provided in the same manner as in the example of FIG. 1. Therefore, the vibration speaker 200 of FIG. 5 may also significantly improve sound pressure in the low frequency band compared to the conventional one and may also prevent the phenomenon that sound is distorted.

As is apparent from the above, a vibration speaker according to various exemplary embodiments of the present invention can concentrate vibration energy in the center portion of a vibration plate to effectively excite the vibration plate, improving low tone output because the vibration energy transmitted from a voice coil member is transmitted to the vibration plate through a vibration transmission portion having a relatively small cross-sectional area.

Furthermore, the vibration speaker according to various exemplary embodiments of the present invention can significantly improve sound pressure in a low frequency band compared to a conventional one and can prevent a phenomenon that sound is distorted in the low frequency band because a circumferential support member can suppress unstable vibrations of the voice coil member and an advance and retreat guide can suppress unstable vibrations of a vibrator.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A vibration speaker apparatus comprising:

a vibration plate fixed to a housing;

a vibrator mounted in the housing to vibrate in a vibration direction of the vibration plate and having a magnet forming a magnetic field;

a voice coil member configured to vibrate the vibration plate through interaction of the magnet with the vibrator;

a vibration transmission member configured to support the voice coil member in a state of being fixed to an internal surface of the vibration plate and transmit vibration of the voice coil member to the vibration plate; and a circumferential support member provided to surround an outside of the vibration transmission member, and having a first side fixed to a circumference of the voice coil member and a second side fixed to a portion of the internal surface of the vibration plate, wherein the vibration transmission member includes:

a spacing support portion fixed to the voice coil member to be spaced from the internal surface of the vibration plate; and a vibration transmission portion protruding from the spacing support portion to be fixed to the internal surface of the vibration plate, and wherein the vibration transmission portion is provided at a position coincident with a center portion of the voice coil member, and a cross-sectional area of a portion thereof fixed to the vibration plate is smaller than a cross-sectional area of the voice coil member.

2. The vibration speaker apparatus according to claim 1, wherein the circumferential support member is made of an elastic material and provided to increase in diameter from the voice coil member toward the vibration plate.

3. The vibration speaker apparatus according to claim 1, wherein the vibrator further includes:

a first yoke provided in an internal space of the voice coil member and coupled to a first end portion of the magnet to face a connection plate of the voice coil member; and a second yoke coupled to a second end portion of the magnet opposite to the first yoke.

4. The vibration speaker apparatus according to claim 3, wherein the second yoke includes a cylindrical extension portion having a diameter greater than an external diameter of the voice coil member and extending to surround an outside of the voice coil member.

5. The vibration speaker apparatus according to claim 3, wherein the vibrator includes a cylindrical case to surround an outside of the second yoke.

6. The vibration speaker apparatus according to claim 3, wherein the voice coil member includes:

a connection plate facing an internal surface of the vibration plate at an end portion thereof; and a bobbin formed on the connection plate, wherein a coil is wound around the bobbin.

7. The vibration speaker apparatus according to claim 6, further including:

an elastic connection member connecting a circumference of the voice coil member and the vibrator, wherein the coil is mounted in an internal space formed by the bobbin, the elastic connection member and the second yoke.

8. A vibration speaker apparatus comprising:

a vibration plate fixed to a housing;

a vibrator mounted in the housing to vibrate in a vibration direction of the vibration plate and having a magnet forming a magnetic field;

a voice coil member configured to vibrate the vibration plate through interaction of the magnet with the vibrator;

a vibration transmission member configured to support the voice coil member in a state of being fixed to an internal surface of the vibration plate and transmit vibration of the voice coil member to the vibration plate;

an elastic connection member connecting a circumference of the voice coil member and the vibrator; and an advance and retreat guide supporting an external circumference of the vibrator to guide advance and retreat of the vibrator, wherein the vibration transmission member includes:

a spacing support portion fixed to the voice coil member to be spaced from the internal surface of the vibration plate; and a vibration transmission portion protruding from the spacing support portion to be fixed to the internal surface of the vibration plate.

9. The vibration speaker apparatus according to claim 8, wherein the advance and retreat guide includes:

at least one guide structure fixed in the housing and including a support portion provided corresponding to a circumference of the vibrator; and a bearing located between an internal surface of the at least one guide structure and an external surface of the vibrator to slidably support the vibrator.

10. A vibration speaker apparatus comprising:

a vibration plate fixed to a housing;

a vibrator mounted in the housing to vibrate in a vibration direction of the vibration plate and having a magnet forming a magnetic field; and a voice coil member configured to vibrate the vibration plate through interaction of the magnet with the vibrator;

a circumferential support member provided to surround an outside of a vibration transmission portion, and having a first side fixed to a circumference of the voice coil member and a second side fixed to an internal surface of the vibration plate, wherein the voice coil member includes:

a bobbin on which a coil is wound, the bobbin including a connection plate facing the internal surface of the vibration plate at an end portion of the bobbin; and the vibration transmission portion protruding from a center portion of the connection plate to be fixed to the vibration plate.

11. The vibration speaker apparatus according to claim 10, wherein the vibration transmission portion is provided integrally with the connection plate, and a cross-sectional area of a portion of the vibration transmission portion fixed to the vibration plate is smaller than a cross-sectional area of the bobbin.

12. The vibration speaker apparatus according to claim 10, wherein the circumferential support member is made of an elastic material and provided to increase in diameter from the voice coil member toward the vibration plate.

13. A vibration speaker apparatus comprising:

a vibration plate fixed to a housing;

a vibrator mounted in the housing to vibrate in a vibration direction of the vibration plate and having a magnet forming a magnetic field;

a voice coil member configured to vibrate the vibration plate through interaction of the magnet with the vibrator;

an elastic connection member connecting a circumference of the voice coil member and the vibrator; and an advance and retreat guide supporting an external circumference of the vibrator to guide advance and retreat of the vibrator, wherein the voice coil member includes:

a bobbin on which a coil is wound, the bobbin including a connection plate facing an internal surface of the vibration plate at an end portion of the bobbin; and a vibration transmission portion protruding from a center portion of the connection plate to be fixed to the vibration plate.

14. The vibration speaker apparatus according to claim 13, wherein the advance and retreat guide includes:

at least one guide structure fixed in the housing and including a support portion provided corresponding to a circumference of the vibrator; and a bearing located between an internal surface of the at least one guide structure and an external surface of the vibrator to slidably support the vibrator.

* * * * *